US008511871B2

(12) United States Patent
Liu et al.

(10) Patent No.: US 8,511,871 B2
(45) Date of Patent: Aug. 20, 2013

(54) STRUCTURE OF PLUG-IN LIGHT STRING

(75) Inventors: Chun-Ming Liu, Hsinchu (TW); Uei-Shin Chen, Hsinchu (TW)

(73) Assignee: Chun-Ming Liu, Hsinchu (TW)

( * ) Notice: Subject to any disclaimer, the term of this patent is extended or adjusted under 35 U.S.C. 154(b) by 541 days.

(21) Appl. No.: 12/851,544

(22) Filed: Aug. 5, 2010

(65) Prior Publication Data

US 2012/0033439 A1 Feb. 9, 2012

(51) Int. Cl.
*F21S 8/00* (2006.01)
*H01R 33/00* (2006.01)

(52) U.S. Cl.
USPC ..... 362/427; 362/654; 439/699.1

(58) Field of Classification Search
USPC ..... 362/680, 647, 652, 249.02, 249.06, 362/249.19, 427; 439/680, 699.1, 699.2
See application file for complete search history.

(56) References Cited

U.S. PATENT DOCUMENTS 6,123,433 A * 9/2000 Chen ..... 362/654
7,222,987 B2 * 5/2007 Tseng ..... 362/219
7,950,840 B2 * 5/2011 Liu et al. ..... 362/654

* cited by examiner

*Primary Examiner* — Joseph L Williams

(57) ABSTRACT

A structure of plug-in light string is provided, including a light shell, a separation element, an LED and a plurality of wires. The two metal leads extended from the LED are soldered to respective wires. The top of the separation element presses against the bottom of the LED, and the separation element and the LED are plugged into the light shell. The LED extends partially from the top opening of the light shell, and the separation element is buckled to the light shell to fasten the position of each component. Inside the light shell, the separation element separates the connection segments of the two metal leads and the wires. In this manner, the structure of plug-in light string is constituted to achieve advantages of easy assembly, water-proof effect, safe usage and small size.

6 Claims, 10 Drawing Sheets

STRUCTURE OF PLUG-IN LIGHT STRING

FIELD OF THE INVENTION

The present invention generally relates to a structure of plug-in light string, and more specifically to a light string using LED as light source, easy to assemble and providing sturdy connection.

BACKGROUND OF THE INVENTION

Light string is a popular decoration for various venues and occasions, especially during holidays. The structure of light string mainly includes a light head and a light plug, commonly called lampholder and lampbase, respectively. In addition to lampholder and lampbase, the structure also includes LED and wires. When assembled, LED is placed in the lampbase, with the metal leads of the LED extending to outside of the shell of the lampbase and bended towards two opposite sides. The wires are connected to a copper plate terminal. The copper plate terminal and the wires are placed inside the lampholder and fastened. Finally, the lampbase is plugged into the lampholder to accomplish the electrical connection of the metal leads of the LED and the copper plate terminal of the wires. The above structure reveals the assembly process is a complicated sequence of manual operations, which is economically disadvantaged as the labor cost increases.

Another type of LED light string is to place an insulation element between the two metal leads of LED. The outer layer is then sheathed in a thermo-shrunk structure to fasten the LED. This structure requires a heating step during the packaging process to shrink the thermo-shrunk sheath. The high temperature may damage the LED. Some other types even require the injection of insulative glue for water-proof. The expensive material and the complicated process are prohibitive in terms of market competition.

SUMMARY OF THE INVENTION

The primary object of the present invention is to provide a structure of plug-in light string. The structure provides sturdy connection and is safe to use, small in size, easy and fast to assemble. The structure allows the automatic assembly and soldering of LED and wires, and keeps the easy manual module plug-in for the remaining process. The conventional copper plate terminal is eliminated, and neither insulation element nor thermo-shrunk sheath is involved so that the heating step causing damages to the product is eliminated. Hence, the structure can facilitate the cost reduction to be more competitive.

To achieve the above object, the present invention provides a structure of plug-in light string, including a light shell, a separation element, an LED and a plurality of wires. The two metal leads extended from the LED are soldered to respective wires. The top of the separation element presses against the bottom of the LED, and the separation element and the LED are plugged into the light shell. The LED extends partially from the top opening of the light shell, and the separation element is buckled to the light shell to fasten the position of each component. Inside the light shell, the separation element separates the connection segments of the two metal leads and the wires. In this manner, the structure of plug-in light string is constituted.

The structure of plug-in light string of the present invention refers to the structure having skeleton bottom at the light shell so that the LED and the separator can be plugged into from the light shell bottom for related assembly.

In order to accomplish water-proof effect, an O-ring is employed optionally. A water-proof ring with similar out diameter can be put around the LED. When assembled, the water-proof ring is fastened to the junction of the LED and the light shell.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
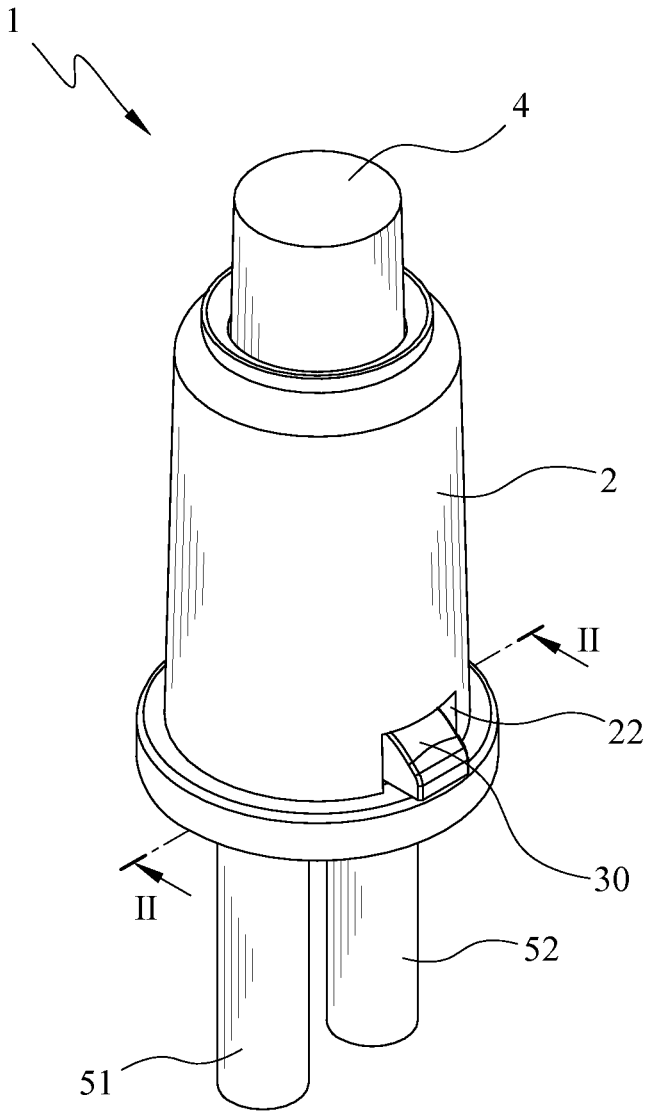
FIG. 1 shows a schematic view of the first embodiment of the present invention.
Figure 2:
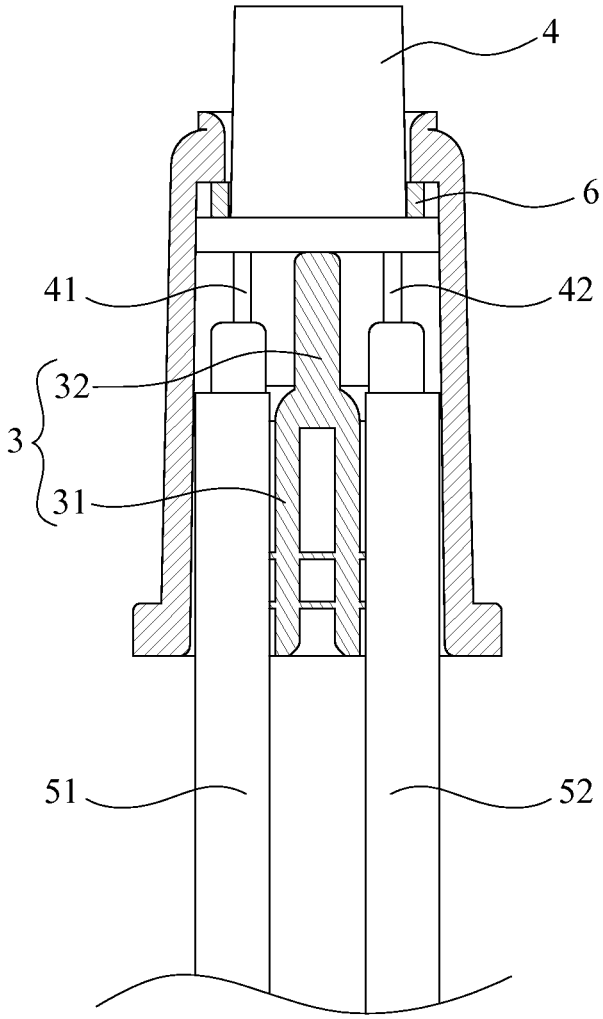
FIG. 2 shows an AA cross-section view of the first embodiment of FIG. 1.

FIG. 1 and FIG. 2 show a schematic three-dimensional view and a cross-sectional view respectively. As shown in FIG. 1 and FIG. 2, a light string 1 of the present invention includes a light shell 2, a separation element 3, an LED 4 and a plurality of wires 51, 52. Two metal leads 41, 42 extended from LED 4 are soldered to respective wires 51, 52. The top of separation element 3 presses against the bottom of the insulation of LED 4, and the connection between metal lead 41 and wire 51 and the connection between metal lead 42 and wire 52 are located on two sides of separation element 3. When assembled, LED 4 and separation element 3 are plugged into light shell 2 from the bottom opening. Then, LED 4 partially extends outside from the top opening of light shell 2. Separation element 3 is buckled to light shell 2 so as to fasten all the components.

Figure 3:
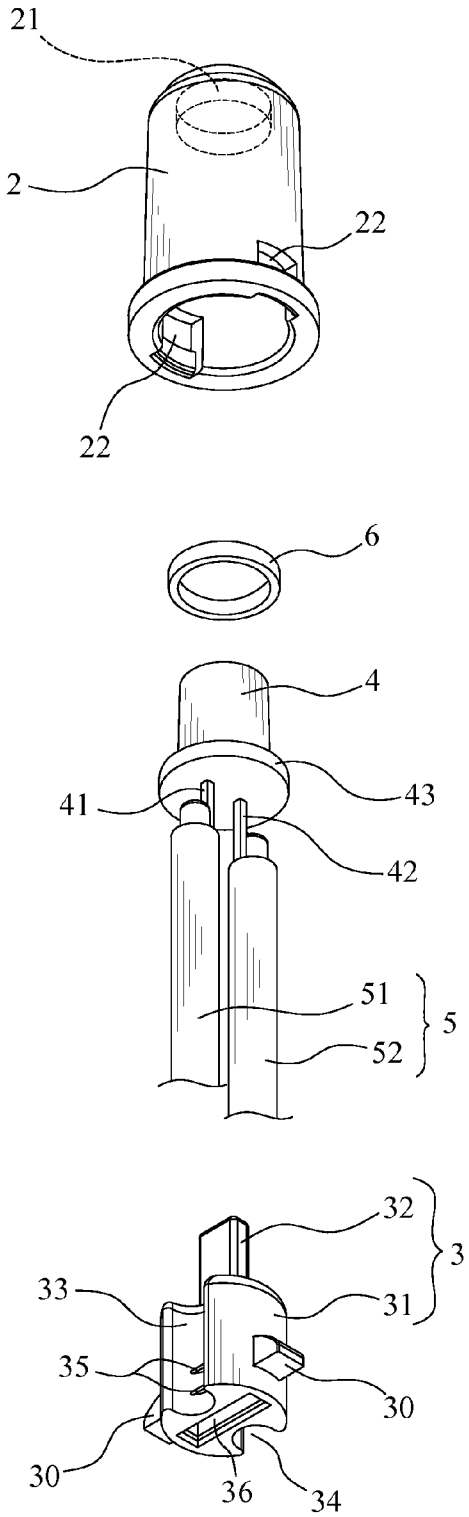
FIG. 3 shows a dissected view of the first embodiment of the present invention.

The following describes the details of each component. As shown in FIG. 3, LED 4 has two metal leads 41, 42. Metal leads 41, 42 are soldered to respective wires 5 by automatic machine to reduce the process time for electrical connection of LED 4 and wires 5. The outer wall of LED 4 forms a protruding ring 43 with slightly larger diameter. Protruding ring 43 is located close to the edge of the bottom insulation of LED 4.

The hollow shell of light shell 2 forms a top opening 21, matching the shape of LED 4, and is smaller in diameter than the protruding ring 43. When LED 4 is plugged in light shell 2, the part of LED 4 above protruding ring 43 is exposed through top opening 21, while the remaining part of LED 4 is restricted inside light shell 2. The inside of light shell 2 is to house separation element 3 to fasten the soldered connections of LED 4 and wires 5 inside the shell. The outer wall of light shell 2 forms at least a hole 22 near the bottom. The present embodiment includes two holes 22 on the opposite side, i.e., 180° apart. In addition, separation element 3 includes at least a buckling block 30 formed on the outer wall. When assembled, separation element 3 is plugged into light shell 2 and buckling block 30 is engaged to hole 22 by protruding through hole 22, as shown in FIG. 1, so as to fasten the position of each component.

The vertical size of separation element 3 is close to the depth of light shell 2. The shape of separation element 3, from the bottom up, includes a first separator 31 and a second separator 32. First separator 31 is much larger in size than second separator 32. The shape of first separator 31 is close to the internal shape of light shell 2. The outer wall of first separator 31 forms two vertical guiding trenches 33, 34. Guiding trenches 33, 34 are 180° apart. Guiding trench 33 provides accommodation to house metal lead 41 of LED 4 and connected wire 51, and guiding trench 34 provides accommodation to house metal lead 42 of LED 4 and connected wire 52. Second separator 32 has a plate shape, and is located at the central area of the top surface of first separator 31. The objective of second separator 32 is to separate metal lead 41 from metal lead 42. When assembled, first separator 31 and wires 51, 52 housed inside guiding trenches 33, 34 are responsible for sealing the bottom opening of light shell 2 so as to achieve water-proof effect. The vertical inner walls of guiding trenches 33, 34 form at least a protruding element 35. Protruding element 35 of the present embodiment has a plate shape. Each guiding trench has two protruding elements 35. When assembled, protruding elements 35 will tightly press against the outer wall of wires 51, 52 so that wires 51, 52 are fastened by separation element 3 and light shell 2. Furthermore, separation element 3 forms a concave trench 36 at the bottom of first separator 31. Concave trench 36 is to allow the user to insert a tool inside concave trench 36 during assembly so that separation element 3 can be easily plugged into light shell 2.

In addition, light string 1 of the present invention can further include a water-proof ring 6, put around LED 4 and located at the top edge of protruding ring 43. When assembled, water-proof ring 6 is put around the part of LED 4 inside light shell 2, and is fastened to the junction of protruding ring 43 of LED 4 and light shell 2 so as to enhance the water-proof effect.

In summary, the present invention is to use automatic machine to solder LED to wires for electrical connection to reduce the time and cost when performed by manual labor, and to improve the yield rate. Then, the light shell and the separation elements of the present invention are used to facilitate manual labor for fast assembly into a light string, with advantages of sturdy connection, tight sealing, safe usage, small size and easy assembly.

Figure 4:
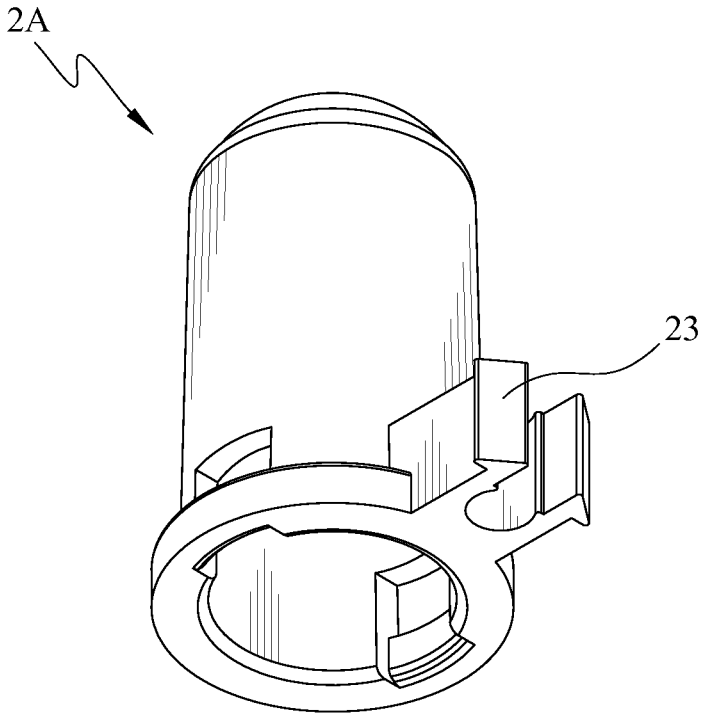
FIG. 4 shows a schematic view of the second embodiment of the present invention.
Figure 5:
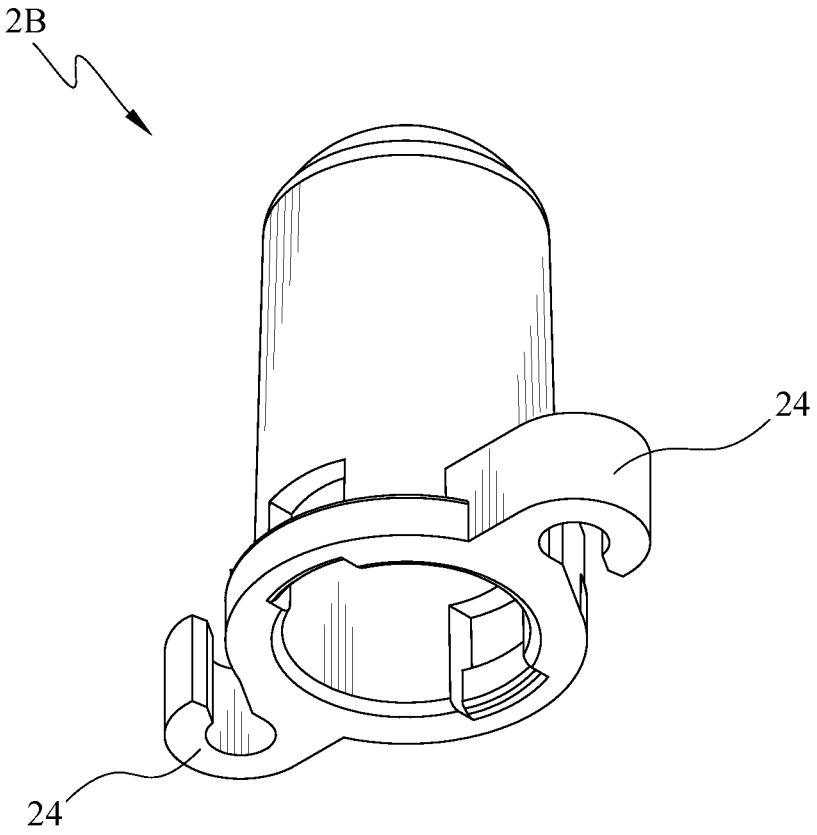
FIG. 5 shows a schematic view of the third embodiment of the present invention.

FIG. 4 and FIG. 5 show the second and the third embodiments of the present invention. These two embodiments are to improve the shape of the light shell. In the embodiment of FIG. 4, the outer wall of light shell 2A includes a clapper to provide clapping to wire or other designed frame. In the embodiment of FIG. 5, the outer wall of light shell 2B includes two hook-shaped buckle elements 24, located 180° apart. These two embodiments show that when a plurality of light strings are connected, clapper 23 or hook-shaped buckle elements 24 can be used to attach to different wires for form a fishnet shape of light decoration.

Figure 6:
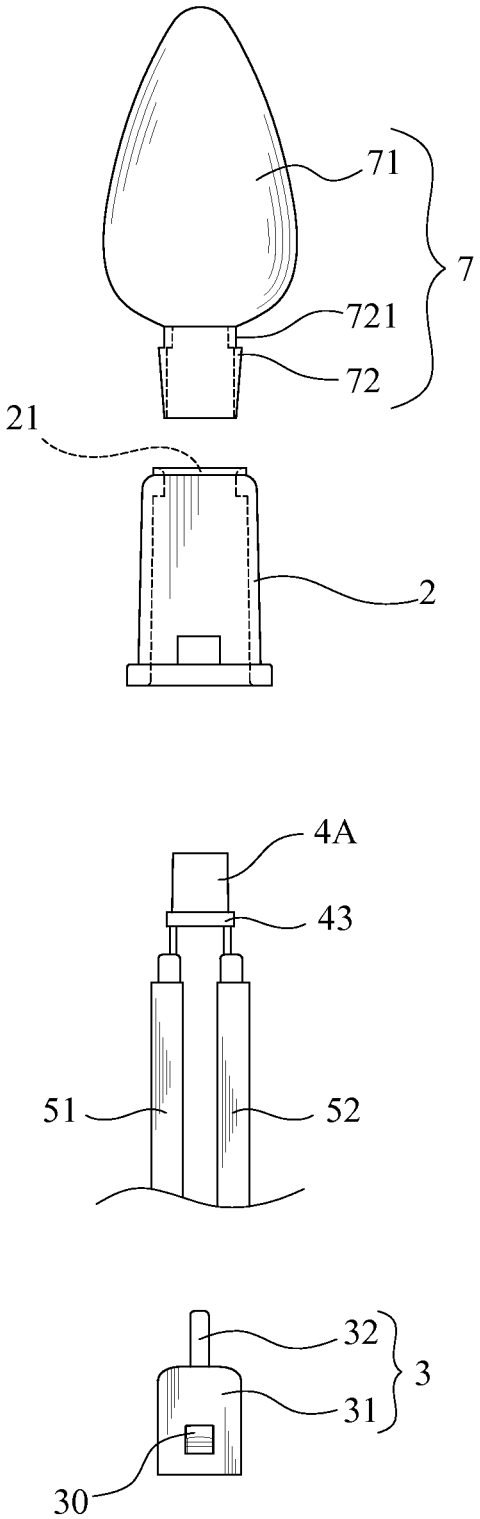
FIG. 6 shows a dissected view of the fourth embodiment of the present invention.
Figure 7:
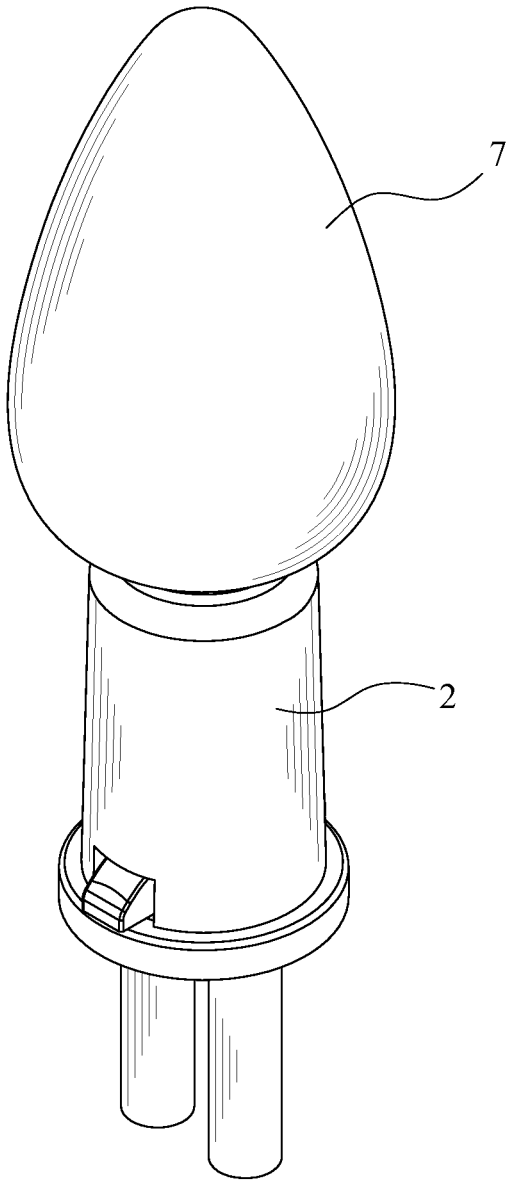
FIG. 7 shows a schematic view of the fourth embodiment of the present invention.

FIG. 6 and FIG. 7 show a dissected view and schematic three-dimensional view of the fourth embodiment, respectively. In the present embodiment, light string 1 further includes a light shade 7, and the remaining components, such as light shell 2 and separation element 3, are the same as in the previous embodiments. Light shade 7 includes a light-through mask 71 and an engaging element 72. Engaging element 72 is a hollow connection tube, forming a neck part 721 of a slightly smaller diameter on the tube wall. The size of neck part 721 is similar to opening 21 of light shell 2. When assembled, engaging element 72 of light shade 7 is inserted into opening 21 of light shell 2 so that neck part 721 is stuck at opening 21 to fasten light shade 7 at the top edge of light shell 2. In the present embodiment, the size of LED 4A is smaller than the size of LED of the first embodiment so that LED 4A can enter light-through mask 71 via engaging element 72, while protruding ring 43 of LED 4A will be stuck inside engaging element 72. With light shade 7, the light from LED 4A will be more uniformly dispersed.

Figure 8:
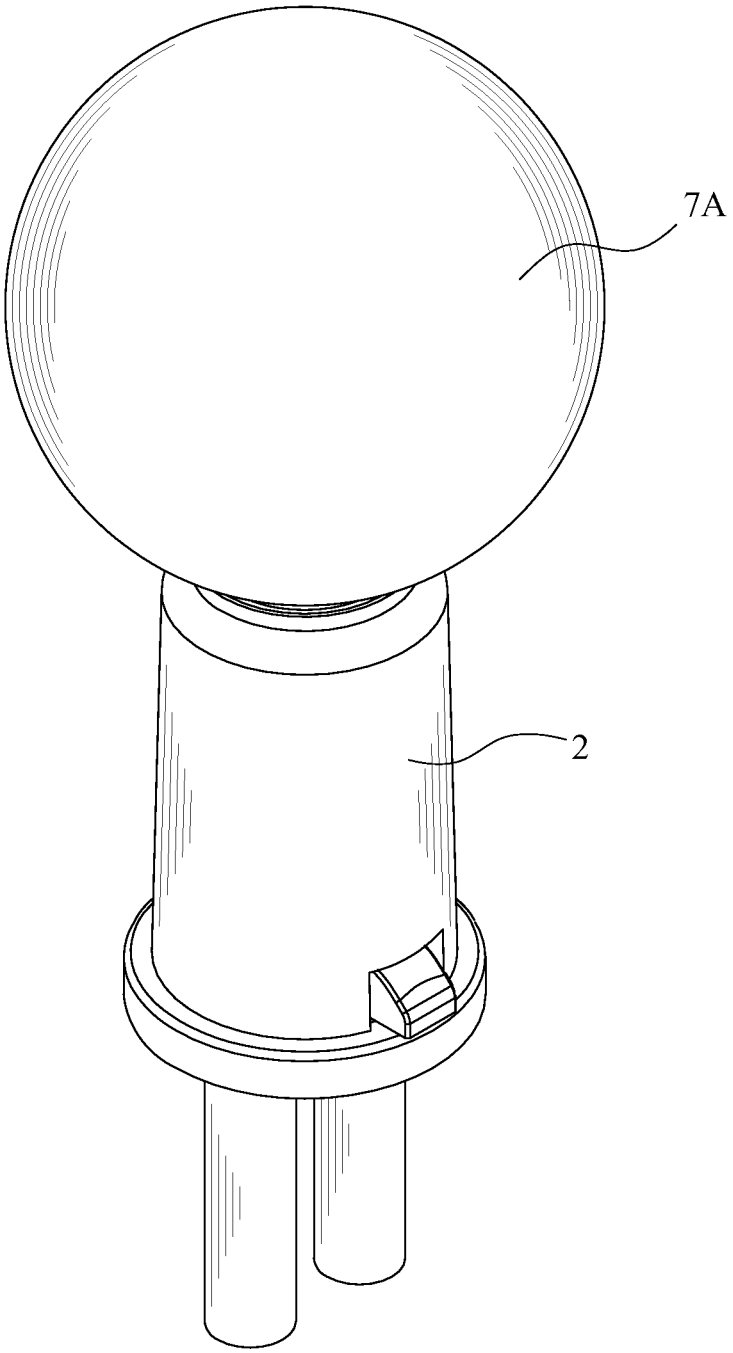
FIG. 8 shows a schematic view of the fifth embodiment of the present invention.
Figure 9:
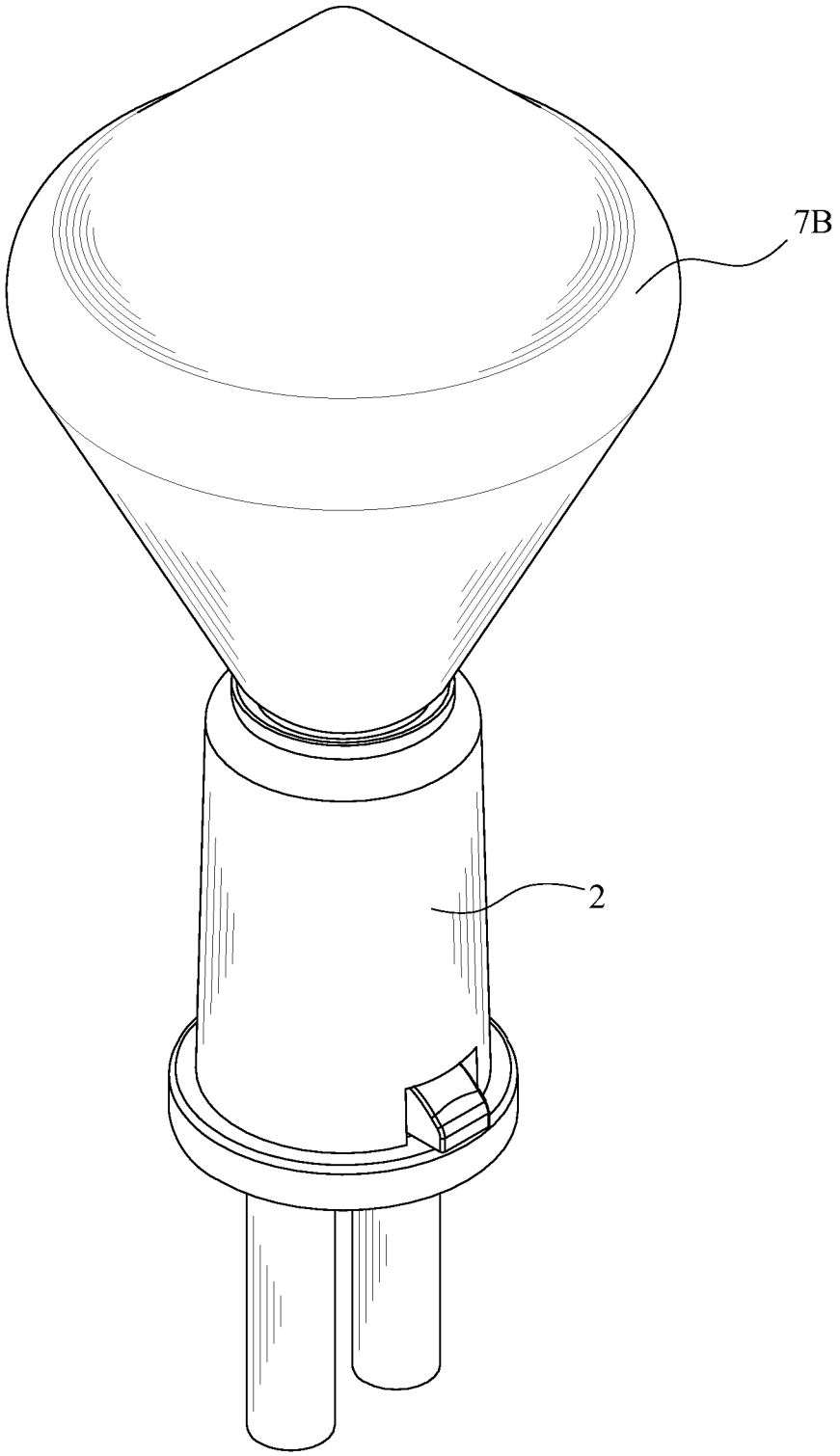
FIG. 9 shows a schematic view of the sixth embodiment of the present invention.

FIG. 8 and FIG. 9 show the fifth and the sixth embodiments of the present invention respectively. In the embodiment of FIG. 8, light shade 7A has a globe shape, while in the embodiment of FIG. 9, light shade 7B has a diamond shape. It is obvious that the shape of the light shade of the present invention is not restricted to any specific shape, and any equivalent design is within the scope of the present invention.

Figure 10:
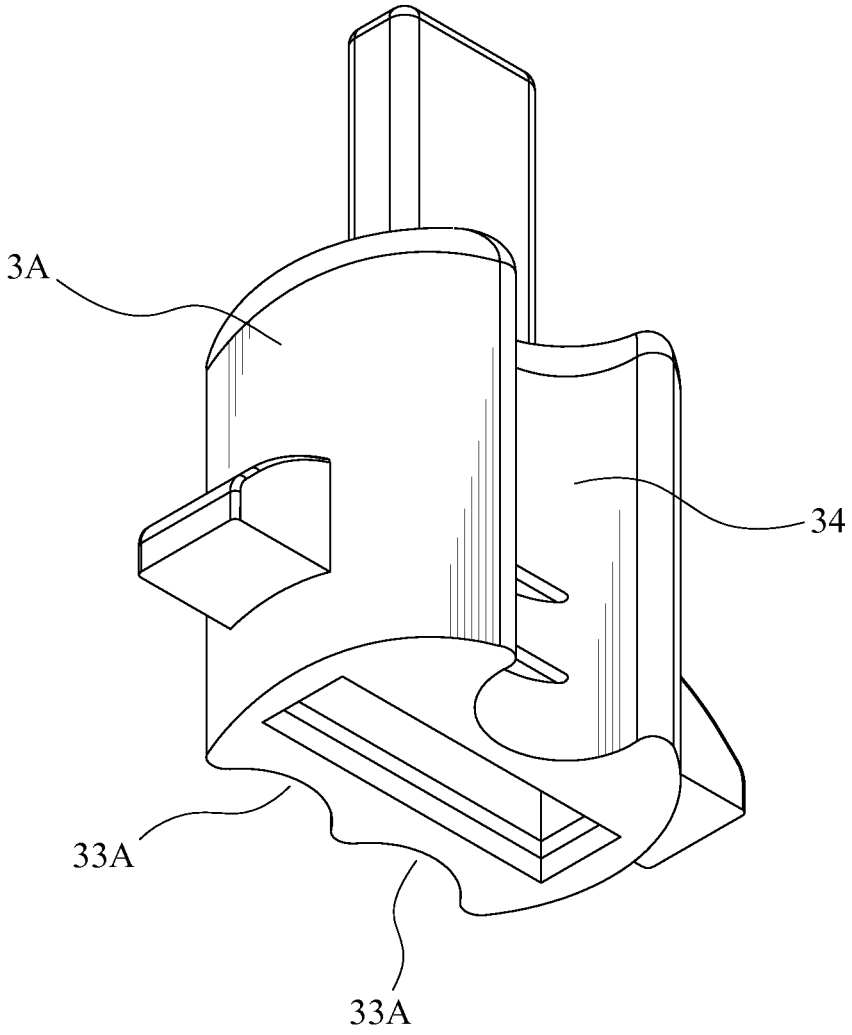
FIG. 10 shows a schematic view of the seventh embodiment of the present invention.

FIG. 10 shows the seventh embodiment of the present invention. This embodiment shows an improvement over separation element 3A. In the present embodiments, separation element 3A includes 1 guiding trench 34 and two guiding trenches 33A, where guiding trenches 33A are located on the same side. This embodiment is used for the light string with three wires.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A structure of plug-in light string, comprising:

a light shell, a separation element, an LED and a plurality of wires; two metal leads extended from said LED being soldered to respective wires, top of said separation element pressing against bottom of said LED, said LED and said separation element being both inserted into said light shell; said LED partially extending from top opening of said light shell, said separation element being buckled to said light shell to fasten a position of each said component, said separation element inside said light shell separating soldered connections of said metal leads and said wires;

wherein at least a through hole is formed through an outer wall of said light shell, at least a buckling block is formed on an outer wall of said separation element, and said buckling block protrudes through said through hole when said separation element is plugged inside said light shell.

2. The structure as claimed in claim 1, wherein said separation element forms at least a guiding trench on both sides respectively, and each said guiding trench provides accommodation to house one of said soldered connections of said metal leads and said wires.

3. The structure as claimed in claim 2, wherein said guiding trench includes a plurality of protruding elements, pressing tightly against an outer wall of said wire so that said wire is fastened by said separation element and said light shell.

4. The structure as claimed in claim 1, wherein said light shell is a hollow shell, having a smaller top opening matching shape of said LED, and when said LED is inserted into said light shell, partially extending from said opening, a remaining part of said LED is fixed inside said light shell.

5. The structure as claimed in claim 1, further comprising a water-proof ring, said water-proof ring being put around said LED, when assembled, said water-proof ring being fastened to junction of said LED and said light shell.

6. The structure as claimed in claim 1, wherein said separation element has a concave trench at bottom to allow placing a tool inside when placing said separation element into said light shell.

* * * * *